US009643754B2

(12) United States Patent
Brogan

(10) Patent No.: US 9,643,754 B2
(45) Date of Patent: May 9, 2017

(54) ENVELOPES WITH HANGING FEATURES

(71) Applicant: JBM Envelope Company, Lebanon, OH (US)

(72) Inventor: John Brogan, Lebanon, OH (US)

(73) Assignee: JBM Envelope Company, Lebanon, OH (US)

( * ) Notice: Subject to any disclaimer, the term of this patent is extended or adjusted under 35 U.S.C. 154(b) by 0 days.

(21) Appl. No.: 14/680,438

(22) Filed: Apr. 7, 2015

(65) Prior Publication Data

US 2016/0297567 A1 Oct. 13, 2016

(51) Int. Cl.
*B65D 27/04* (2006.01)
*B65D 27/34* (2006.01)

(52) U.S. Cl.
CPC ..... *B65D 27/04* (2013.01); *B65D 27/34* (2013.01)

(58) Field of Classification Search
CPC ... B42D 15/045; A45C 11/182; B65D 5/4208; B65D 27/04; B65D 27/34; G09F 3/20; Y10S 206/806
USPC ..... 229/70, 71, 74, 307–316
See application file for complete search history.

(56) References Cited

U.S. PATENT DOCUMENTS 3,424,167 A * 1/1969 Lennartz ..... B42F 15/0029 229/67.2
4,360,106 A * 11/1982 Irvine ..... B65D 5/4208 206/470
4,937,963 A * 7/1990 Barnes ..... G09F 3/20 40/1.6
5,029,901 A 7/1991 Dotson et al.
6,145,665 A * 11/2000 Krahn ..... B65D 5/4208 206/449
6,209,779 B1 4/2001 Fabel
6,231,082 B1 5/2001 Van Boom et al.
6,315,206 B1 * 11/2001 Hansen ..... A45C 11/182 235/380
6,328,341 B2 * 12/2001 Klure ..... 206/454
6,343,736 B1 2/2002 Kim
6,732,459 B1 * 5/2004 Clark ..... B42D 15/045 206/308.1
7,219,829 B2 * 5/2007 Treat ..... B42D 15/042 229/71
7,240,443 B2 * 7/2007 Nathanson ..... G09F 3/20 229/71
7,467,747 B2 12/2008 Haas et al.
D619,359 S * 7/2010 Pascua ..... D3/247
7,896,252 B2 * 3/2011 Narlinger ..... B42D 15/02 235/487
7,922,208 B2 4/2011 Haas et al.
(Continued)

*Primary Examiner* — Peter Helvey
(74) *Attorney, Agent, or Firm* — Dinsmore & Shohl LLP

(57) ABSTRACT

An envelope includes an envelope body having a first pair of substantially parallel edges that extend in a transverse direction and a second pair of substantially parallel edges that extend in a longitudinal direction, a face and a back. An openable region is formed in the envelope body and is spaced from the first and second pairs of parallel edges that is partially bounded by a line of weakness. The openable region being partially separable from the envelope body to provide a hanging feature. A barrier film is exposed after separation of the openable region from the envelope body. The barrier film is at least partially sealed to the envelope body about at least a portion of the openable region.

16 Claims, 6 Drawing Sheets

(56) References Cited

U.S. PATENT DOCUMENTS

| | | | | |
|---|---|---|---|---|
| 8,231,058 | B2 * | 7/2012 | Eriksen | G07F 7/0833 235/486 |
| 8,272,565 | B2 * | 9/2012 | Halbur | B42D 15/045 235/380 |
| 8,287,004 | B2 | 10/2012 | Rosen et al. | |
| D706,632 | S * | 6/2014 | Glass | D9/457 |
| 2002/0100797 | A1 * | 8/2002 | Hollingsworth | B42D 15/08 229/92.8 |
| 2005/0252955 | A1 | 11/2005 | Sugai et al. | |
| 2015/0250278 | A1 * | 9/2015 | Canaday | A45C 11/182 206/495 |

* cited by examiner

ENVELOPES WITH HANGING FEATURES

TECHNICAL FIELD

The present specification generally relates to envelopes and, more particularly to envelopes with hanging features.

BACKGROUND

It is known to use envelopes for mailing or otherwise transporting letters and documents. Envelopes may be created for other purposes. Scented envelope-type sachets are used for containing scented materials and do not expose the scented materials directly to the surrounding air, which can diminish the rate of scent evaporation or likelihood of exposure, for example, to skin. Typically, the envelope-type sachets are laid in a drawer or on a shelf. What is needed is an envelope that can contain a scented or other material, such as seeds, while allowing a user the ability to hang the envelope without spilling its contents.

SUMMARY

In an embodiment, an envelope includes an envelope body having a first pair of substantially parallel edges that extend in a transverse direction and a second pair of substantially parallel edges that extend in a longitudinal direction, a face and a back. An openable region is formed in the envelope body and is spaced from the first and second pairs of parallel edges that is partially bounded by a line of weakness. The openable region being partially separable from the envelope body to provide a hanging feature. A barrier film is exposed after separation of the openable region from the envelope body. The barrier film is at least partially sealed to the envelope body about at least a portion of the openable region.

In another embodiment, an envelope includes an envelope body having a first pair of substantially parallel edges that extend in a transverse direction and a second pair of substantially parallel edges that extend in a longitudinal direction, a face and a back. A hanging feature is formed in the envelope body. The hanging feature has an initial configuration forming an openable region spaced from the first and second pairs of parallel edges that is at partially bounded by a line of weakness in the envelope body and a hanging configuration where the hanging feature is partially separated from the envelope body. A barrier film is exposed with the hanging feature in the hanging configuration. The barrier film is at least partially sealed to the envelope body about at least a portion of the openable region.

In another embodiment, a method of forming an envelope is provided. The method includes forming a hanging feature in a paper sheet. The hanging feature has an initial configuration forming an openable region that is at partially bounded by a line of weakness. A barrier film is adhered about a periphery of the hanging feature with the hanging feature in the initial configuration. The paper sheet is folded to form an envelope body having a first pair of substantially parallel edges that extend in a transverse direction and a second pair of substantially parallel edges that extend in a longitudinal direction, a face and a back. The openable region is spaced from the first and second pairs of parallel edges. The hanging feature has a hanging configuration where the openable region is partially separated from the envelope body to expose the barrier film.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to envelopes that contain a scented material that can be perceived by a user from outside the envelopes. In some embodiments, the material contained may not be a scented material, such as seeds or other materials. The envelopes may generally include an envelope body including a face and a back with one or more hanging features that can be moved from an initial position to a hanging position.

Directional terms as used herein—for example up, down, right, left, front, back, top, bottom—are made only with reference to the figures as drawn and are not intended to imply absolute orientation.

Figure 1:
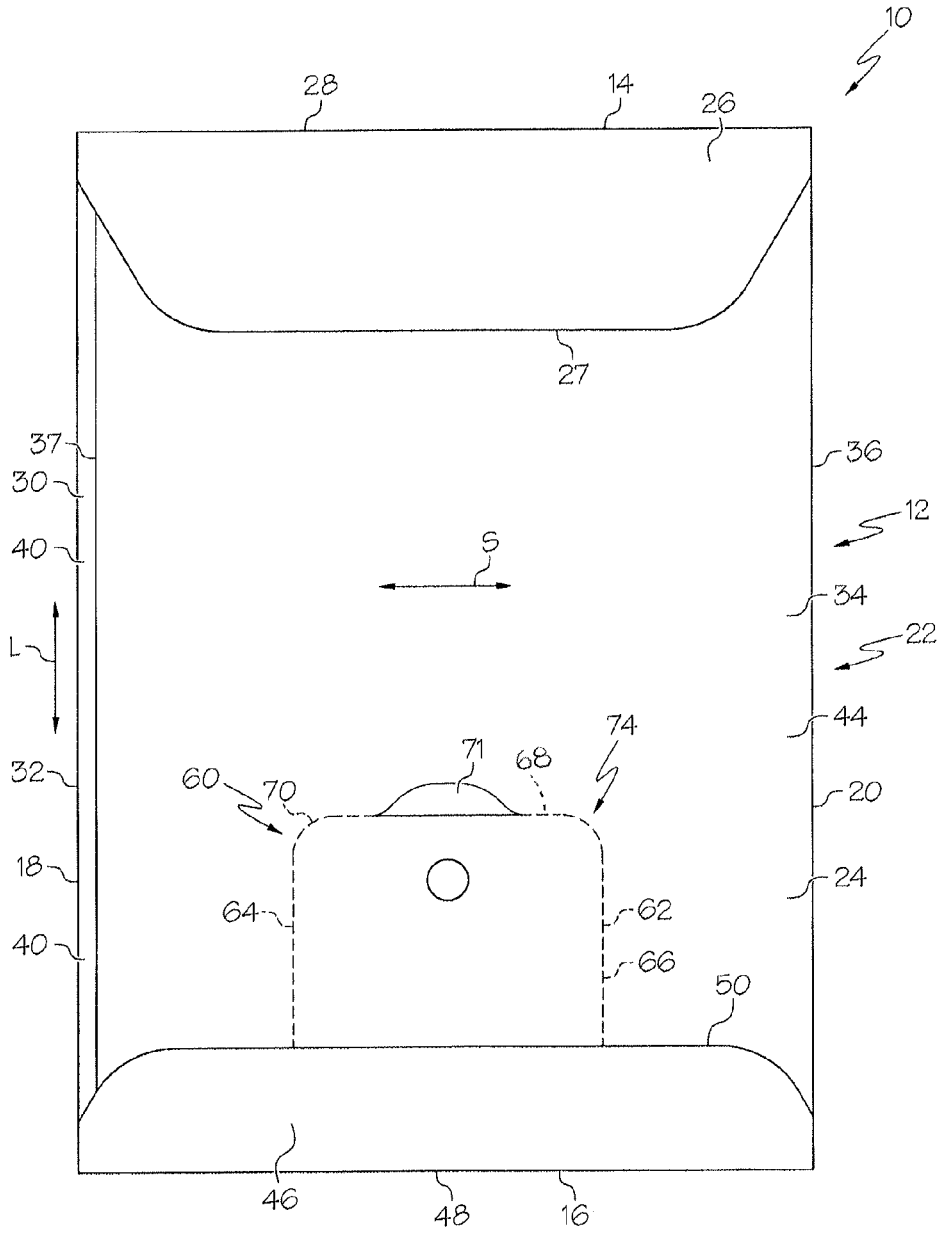
FIG. 1 is a rear view of an envelope including hanging feature and exposable barrier film according to one or more embodiments described herein.

Referring to FIG. 1, an exemplary envelope 10 includes an envelope body 12 having a relatively long dimension L and a relatively short dimension S perpendicular to the long dimension L. The envelope body 12 may be formed of, for example, a single sheet of paper and includes a first pair of parallel edges 14 and 16 that extend in the direction of the short dimension S (sometimes referred to herein as the transverse direction) and a second pair of parallel edges 18 and 20 that extend in the direction of the long dimension L (sometimes referred to as the longitudinal direction). The envelope body 12 further includes relatively broad front and rear sides referred to herein as a face 22 and a back 24 that extend between the edges 14, 16, 18 and 20.

At the back 24, the envelope 10 includes a top flap 26 that is connected to the front 22 by a fold 28 and folds over the envelope body 12. The top flap 26 may include a seal adhesive (e.g., formed using gum arabic or a petroleum-based material) applied along an outer edge 27 or some other adhesive structure, such as an adhesive sticker, tape, glue, etc. that is used to at least partially seal the top flap 26 to the envelope body 12. The envelope body 12 further includes a first side flap 30 that is connected to the front 22 by a fold 32 and a second side flap 34 having a side seam construction extending from a fold 36. In the illustrated embodiment, an inner facing side 38 of the second side flap 34 (FIG. 4) is connected or sealed to an outer facing side 40 of the first side flap 30 at a seam overlap 37, for example, by an adhesive therebetween. In other embodiments, an inner facing side 42 of the first side flap 30 (FIG. 4) may be sealed to an outer facing side 44 of the second side flap 34. A bottom flap 46 is connected to the front 22 by a fold 48 and folds over the envelope body 12. The bottom flap 46 may also include a seal adhesive applied along an outer edge 50 or some other adhesive structure, such as an adhesive sticker, tape, glue, etc. that is used to at least partially seal the bottom flap 46 to the envelope body 12.

In the example of FIG. 1, an openable region 60 is located at the bottom flap 46. The openable region 60 is spaced from the folds 28, 32, 36 and 48 and is bounded by a line of weakness 62 (e.g., a perforated line) that extends about a periphery of the openable region 60. The line of weakness 62 has side portions 64 and 66 that extend generally in the long L direction and a top portion 68 that extends generally in the short S direction forming a somewhat rectangular openable region 60 with rounded corners 70. Other shapes are possible for the openable region, such as other polygons, rounded, circles, ovals, irregular shapes, or other designs. In some embodiments, indicia, drawings, colors or otherwise may be printed or otherwise included on the openable region 60. A gap 71 is provided adjacent the openable region 60. As will be described below, the gap 71 facilitates opening of the openable region 60 to expose a film located therebehind that is sealed to the envelope body 12 to inhibit unintended spilling of envelope contents.

Figure 2:
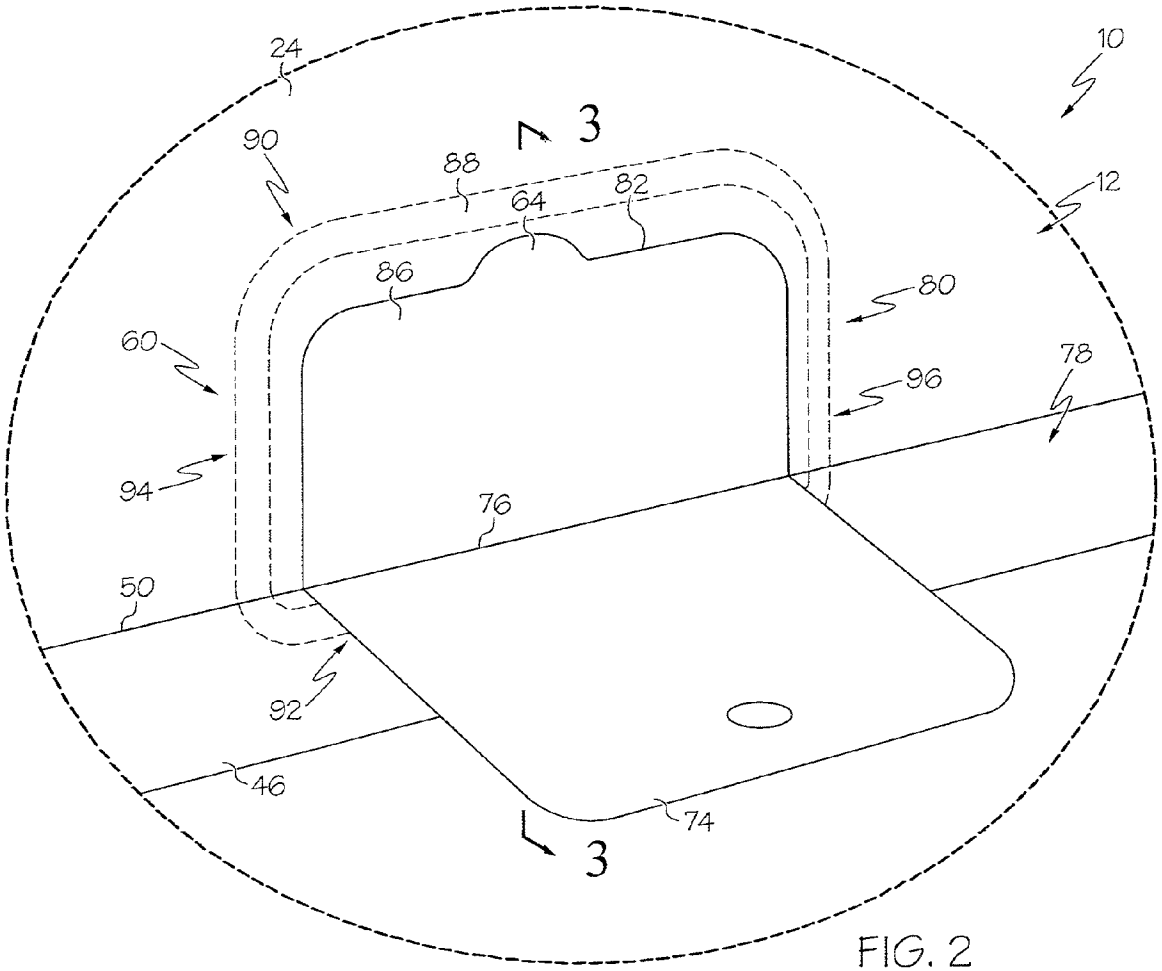
FIG. 2 is a detail view of the envelope of FIG. 1 with the hanging feature removed from the envelope body according to one or more embodiments described herein.

Referring to FIG. 2, the openable region 60 may be partially separated from the rest of the envelope body 12 to form a hanging feature 74. The hanging feature 74, once partially separated from the envelope body 12 along the line of weakness 62, can be moved from an initial position toward a hanging position, which will be described below. In the example of FIG. 2, the hanging feature 74 is illustrated in an intermediate position with the hanging feature 74 being connected to the envelope body 12 at a fold 76, forming somewhat of a living hinge that allows for movement of the hanging feature 74 relative to the back 24 of the envelope body 12. In some embodiments, the fold 76 is formed along and adjacent to the outer edge 50 of the bottom flap 46. The bottom flap 46 can provide a reinforced region 78 adjacent the hanging feature 74 that facilitates formation of the fold 76 adjacent thereto, thereby providing a predictable location for the formation of the fold 76. As can be seen, the fold 76 can follow the outer edge 50 of the bottom flap 46, which can provide a substantially straight fold 76 that extends in the transverse direction of the envelope body 12.

Figure 3:
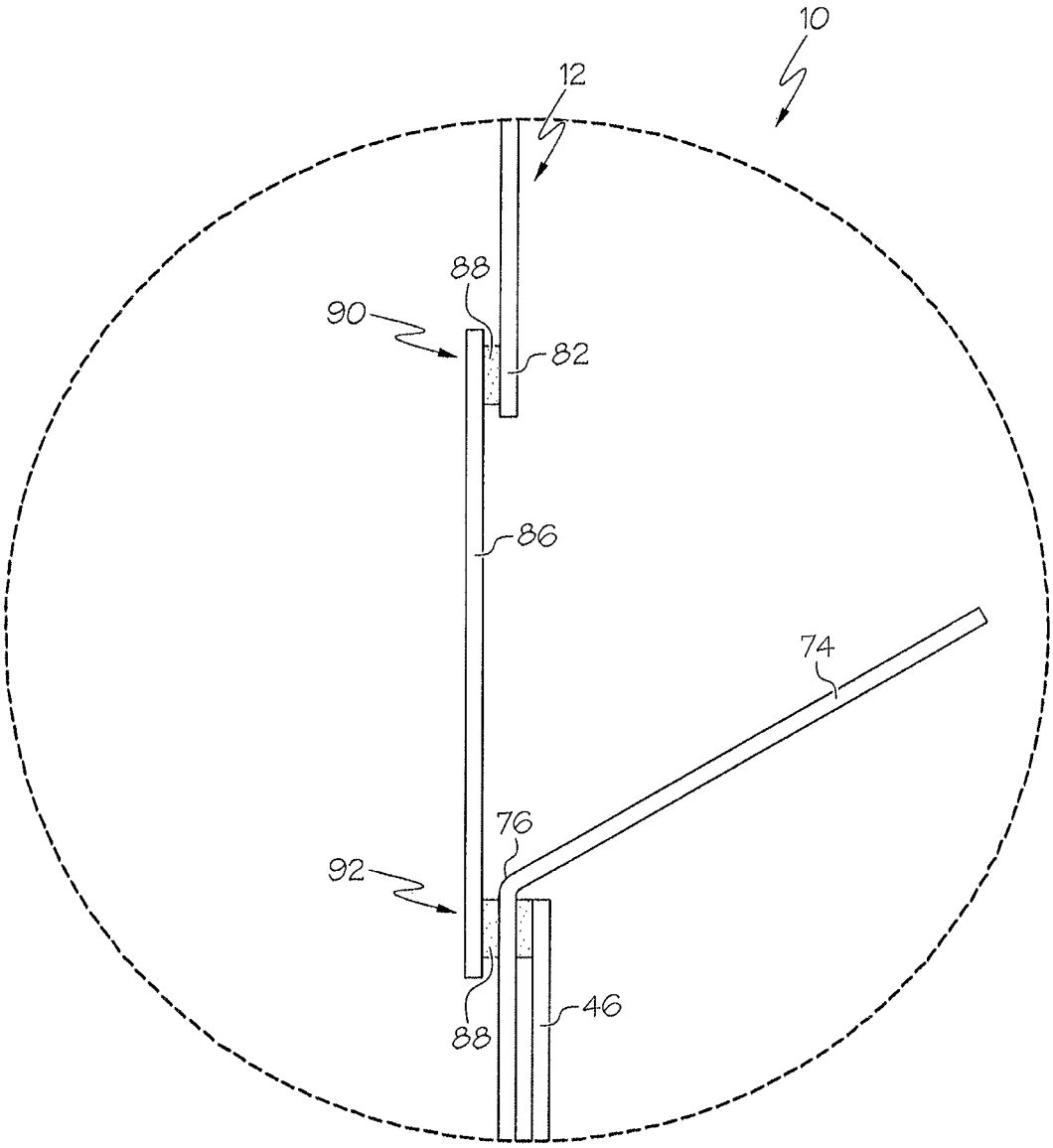
FIG. 3 is a cross-section view along line 3-3 of FIG. 2.

Referring to FIG. 2 and also to FIG. 3, separating the hanging feature 74 from the envelope body 12 exposes a framed region 80. The framed region 80 includes a frame 82 that is formed by an enclosed edge formed by the back 24 when the hanging feature 74 is formed and a barrier film 86 that may be formed of a different material than the envelope body 12 that may be transparent or translucent to allow viewing of contents of the envelope body 12 from outside the envelope 10 and is sealed to the envelope body 12 to inhibit contents from leaving the envelope body 12. In other embodiments, the barrier film 86 may be opaque.

Figure 4:
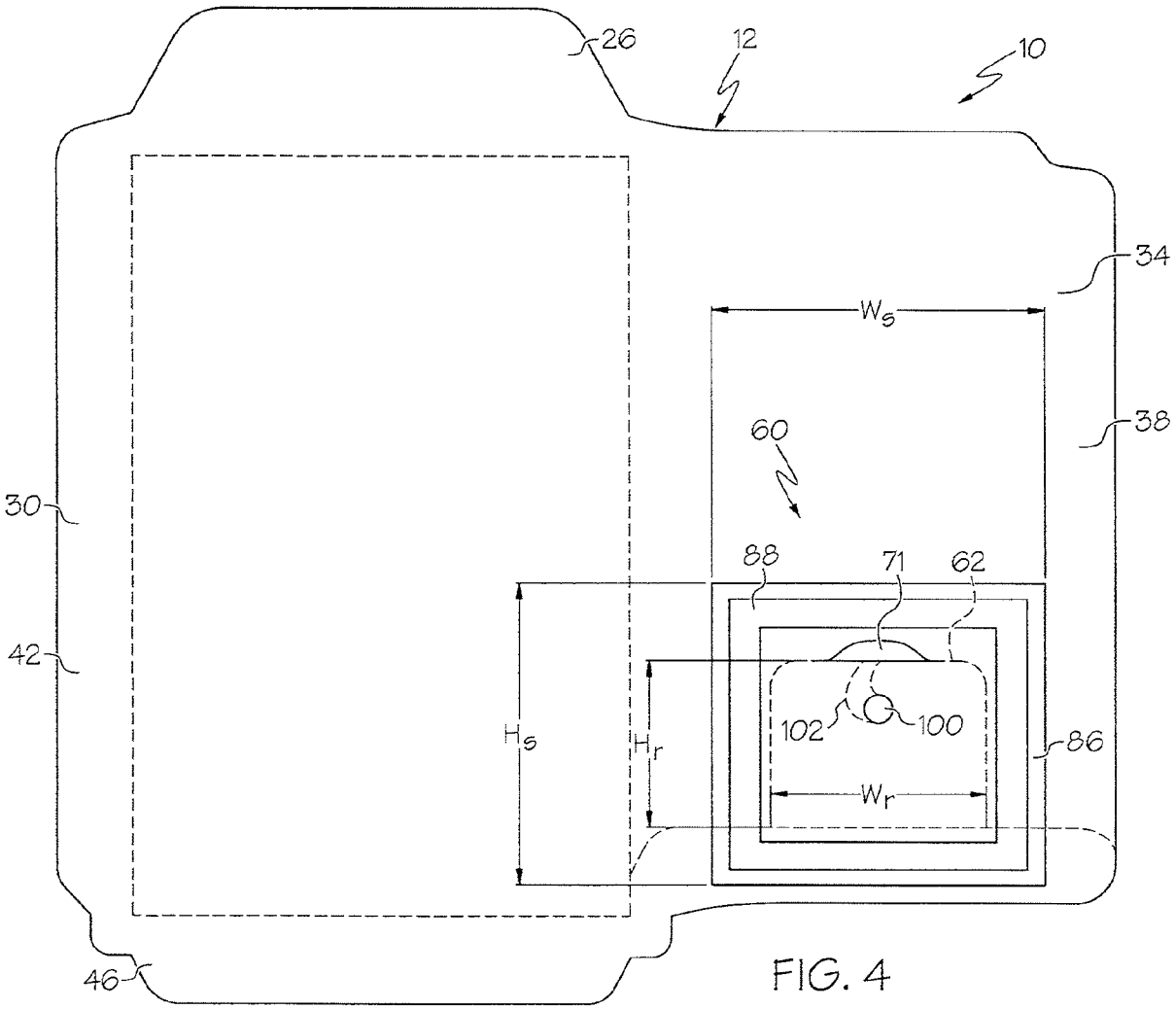
FIG. 4 is a flat, laid-out view of the envelope of FIG. 1.

Referring particularly to FIG. 3, the barrier film 86 may be, for example, a flexible plastic sheet that is air-tight or other suitable material (e.g., a scent permeable/breathable material) that is sealed along a seal 88 to the inner facing side 38 of the second side flap 34 (see also FIG. 4). The seal 88 is formed about the entire periphery of the barrier film 86 including a top portion 90 (including adjacent the gap 71), a bottom portion 92 (including adjacent the fold 76) and side portions 94 and 96 (see FIG. 2), thereby defining a continuous, unbroken seal (see also FIGS. 2 and 4). However, a continuous seal 88 may be effective in inhibiting unintended spillage of contents of the envelope 10 during handling.

Referring to FIG. 4, the envelope 10 is illustrated in its flat, unfolded and laid-out configuration. As described above, the envelope body 12 includes the first side flap 30, the second side flap 34, the top flap 26 and the bottom flap 46. Formed in the second side flap 34 is the openable region 60 that forms the hanging feature. The line of weakness 62 may be formed by punching multiple holes through the second side flap 34 in the illustrated pattern or in any other suitable pattern. The gap 71 may also be formed by punching or otherwise cutting a portion of the second side flap 34 adjacent the openable region 60. A hanging opening 100 may also be provided through the openable region 60, such as the illustrated closed opening, or a slot-like opening, such as a J-shaped or L-shaped opening (e.g., see dashed lines 102).

The barrier film 86 is larger in dimension than that of the openable region 60 (and resulting hanging feature). In the illustrated example, the barrier film 86 has a width $W_s$ and height $H_s$ greater than a width $W_r$ and height $H_r$ (including the height of the gap 71) of the openable region 60 to accommodate the seal 88 that extends continuously around the openable region 60. The seal 88 may also be spaced from the openable region 60 such that no portion of the openable region 60 is adhered to the barrier film 86. Such an unsealed region can facilitate partial separation of the hanging feature from the body 12 to expose the barrier film 86 and formation of the hanging feature.

Figure 5:
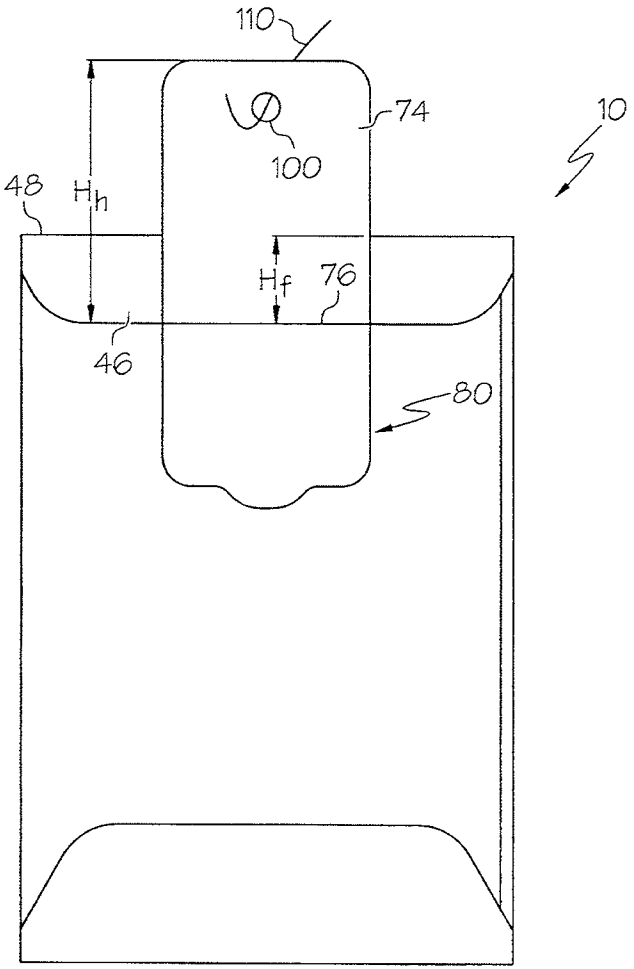
FIG. 5 illustrates the envelope of FIG. 1 with the hanging feature in a hanging configuration and exposing the barrier film according to one or more embodiments described herein.

Referring to FIG. 5, the envelope 10 is illustrated in its folded configuration with the hanging feature 74 illustrated in its hanging position and the barrier film 86 exposed. As can be seen, the hanging feature 74 has a dimension $H_h$ in the longitudinal direction that is greater than a dimension $H_f$ from the fold 76 to the fold 48 of the bottom flap 46. In some embodiments, dimension $H_h$ may be about twice as long or more as dimension $H_f$. Such an arrangement can allow positioning of a distal portion of the hanging feature 74 including the hanging opening 100 at a location beyond the fold 48 of the bottom flap 46, which can provide access to a hanging hook 110 or other structure.

Figure 6:
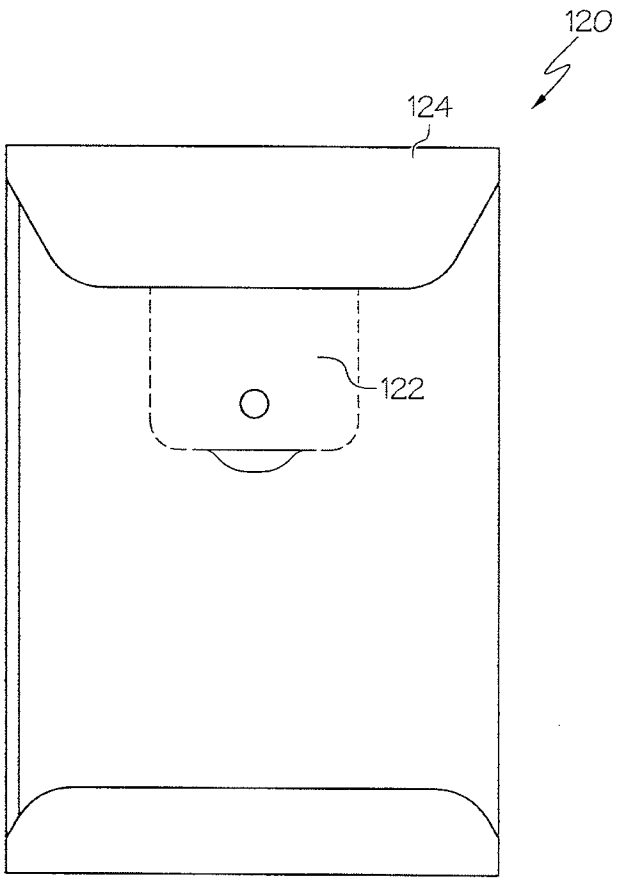
FIG. 6 illustrates another embodiment of an envelope with a hanging feature and exposable barrier film according to one or more embodiments described herein.
Figure 7:
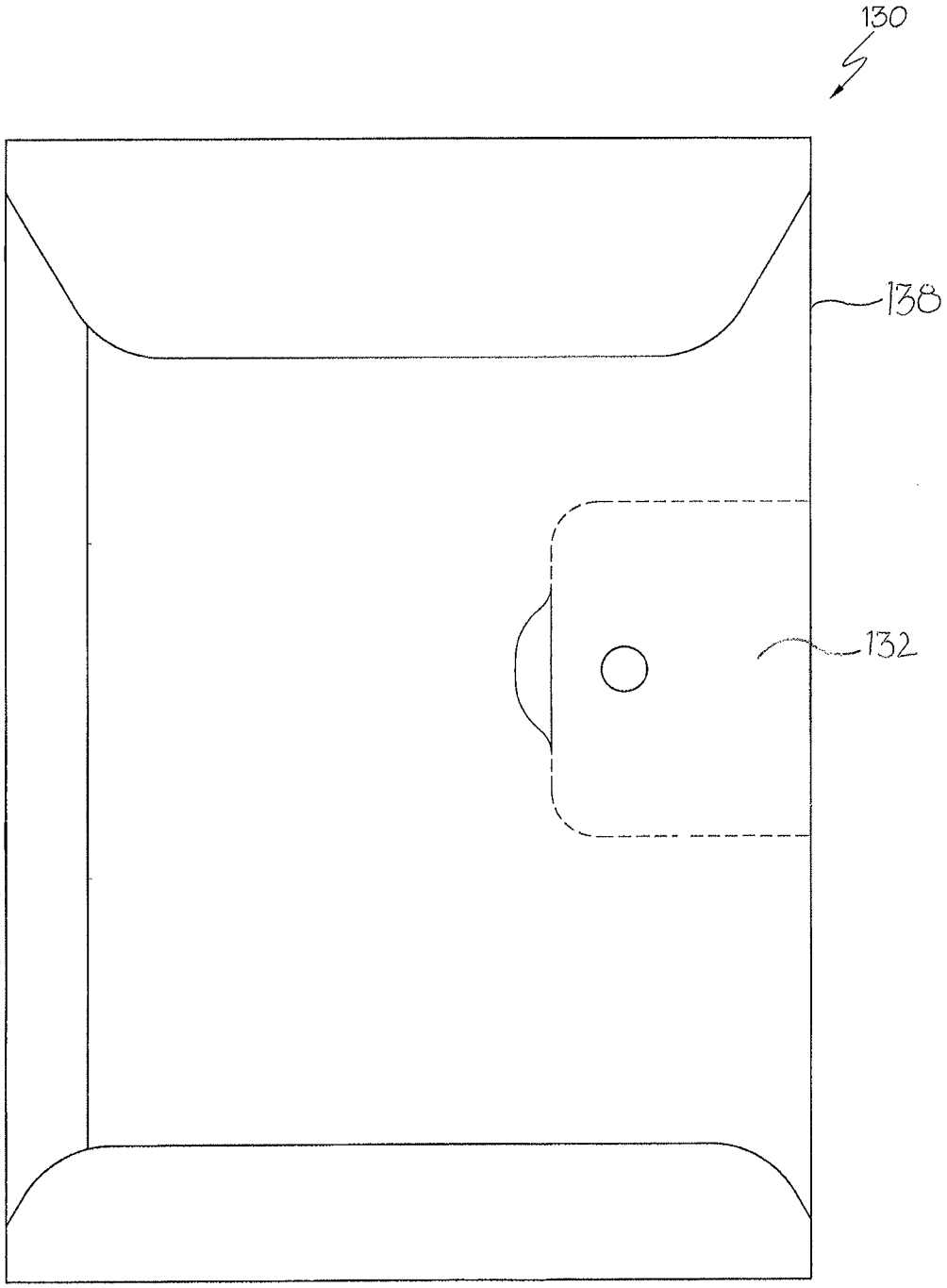
FIG. 7 illustrates another embodiment of an envelope with a hanging feature and exposable barrier film according to one or more embodiments described herein.

While the above-described envelope 10 illustrates the hanging feature 74 near the bottom flap 46, other configurations are possible. For example, referring to FIG. 6, an envelope 120 includes a hanging feature 122 that includes many of the features described above including an openable region. In this embodiment, the hanging feature 122 is located near a top flap 124 and is extendable beyond the top flap 124 to facilitate hanging. Referring to FIG. 7, another envelope 130 includes a hanging feature 132 and barrier film located at a side fold 138 to facilitate hanging.

The above-described envelopes can provide both hanging features and the ability to expose a framed region that is sealed by a barrier film to inhibit unintended spilling of contents and, in some embodiments, through which contents of the envelopes can be viewed. For example, scented materials, such as vermiculite, potpourri, herbs and spices such as vanilla beans, cinnamon sticks, rose petals, and other fragrant items, oils, etc. may be placed in the envelopes and the envelopes can be placed into dresser drawers, cupboards, storage boxes and other storage areas to keep contents and/or surroundings smelling fresh and clean. Other contents may be used, such as seeds. The barrier film may be transparent, translucent or opaque. Designs may be provided on the barrier film, including images, words, designs, logos, etc. The envelopes may be hung within their storage areas using their hanging features. Further, providing a sealed film can allow for viewing of the scented materials, while preventing any unintended spilling of the contents from the envelope from the envelope body.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An envelope comprising:

an envelope body having a first pair of substantially parallel edges that extend in a transverse direction and a second pair of substantially parallel edges that extend in a longitudinal direction, a face and a back;

an openable region formed in the envelope body and spaced from the first and second pairs of parallel edges that is partially bounded by a line of weakness, the openable region being partially separable from the envelope body to provide a hanging feature; and a barrier film that is exposed after separation of the openable region from the envelope body, the barrier film being at least partially sealed to the envelope body about at least a portion of the openable region.

2. The envelope of claim 1, wherein the barrier film comprises a transparent film that allows viewing inside the envelope body.

3. The envelope of claim 1, wherein the barrier film is sealed to an inner surface of the envelope body.

4. The envelope of claim 1, wherein the barrier film is sealed about an entire periphery of the openable region in a continuous fashion.

5. The envelope of claim 1, wherein the openable region has a hanging opening.

6. The envelope of claim 1, wherein the line of weakness comprises perforations.

7. An envelope comprising:

an envelope body having a first pair of substantially parallel edges that extend in a transverse direction and a second pair of substantially parallel edges that extend in a longitudinal direction, a face and a back;

a hanging feature formed in the envelope body, the hanging feature having an initial configuration forming an openable region spaced from the first and second pairs of parallel edges that is at partially bounded by a line of weakness in the envelope body and a hanging configuration where the hanging feature is partially separated from the envelope body; and a barrier film that is exposed with the hanging feature in the hanging configuration, the barrier film being at least partially sealed to the envelope body about at least a portion of the openable region.

8. The envelope of claim 7, wherein the hanging feature is formed of material forming the envelope body, the hanging feature connected to the envelope body by a fold with the hanging feature in the hanging configuration.

9. The envelope of claim 8 further comprising a flap that is connected to the face of the envelope body by a fold.

10. The envelope of claim 9, wherein the fold of the hanging feature extends along an outer edge of the flap at a location spaced from the fold of the flap.

11. The envelope of claim 10, wherein the hanging feature has a dimension extending in the longitudinal direction that is greater than a longitudinal distance between the fold of the hanging feature and the fold of the flap such that the hanging feature extends beyond the fold of the flap in the hanging configuration.

12. The envelope of claim 7, wherein the barrier film is formed of a material different from the envelope body.

13. The envelope of claim 7, wherein the barrier film comprises a transparent film that allows viewing inside the envelope body.

14. The envelope of claim 7, wherein the barrier film is sealed to an inner surface of the envelope body.

15. The envelope of claim 14, wherein the barrier film is sealed to the inner surface about an entire periphery of the film.

16. The envelope of claim 7, wherein the hanging feature has a hanging opening.

* * * * *